United States Patent [19]

Stahlecker et al.

[11] 3,934,396

[45] Jan. 27, 1976

[54] SPINNING UNIT OPERATING IN ACCORDANCE WITH THE OPEN-END METHOD

[76] Inventors: Fritz Stahlecker, Josef-Neidhart-Str. 18, D 7341 Bad Veberkingen; Hans Stahlecker, Haldenstrasse 20, D 7334 Suessen, both of Germany

[22] Filed: Sept. 13, 1973

[21] Appl. No.: 396,710

[30] Foreign Application Priority Data

Sept. 23, 1972 Germany ..... 2246791

[52] U.S. Cl. ..... 57/58.89; 57/34 R; 74/606 A; 308/77

[51] Int. Cl.[2] ..... D01H 1/12; D01H 13/00

[58] Field of Search .....57/58.89–58.95, 34 R, 56; 308/76, 77, 245; 74/606 A

[56] References Cited

UNITED STATES PATENTS

| | | | |
|---|---|---|---|
| 438,644 | 10/1890 | Robertson | 74/606 A X |
| 1,759,415 | 5/1930 | Perlesz | 308/77 |
| 2,196,952 | 4/1940 | Bobaty | 308/77 X |
| 2,315,317 | 3/1943 | Copp et al. | 74/606 A X |
| 2,697,179 | 12/1954 | Wendel | 308/77 X |
| 2,829,286 | 4/1958 | Britz | 308/77 X |
| 3,724,194 | 4/1973 | Greenwood et al. | 57/58.95 X |
| 3,774,382 | 11/1973 | Bartling | 57/58.89 X |
| 3,837,154 | 9/1974 | Stablecker | 57/58.89 |

*Primary Examiner*—Richard C. Queisser
*Assistant Examiner*—Charles Gorenstein
*Attorney, Agent, or Firm*—Craig & Antonelli

[57] ABSTRACT

An open-end spinning unit having a plurality of spinning points, each having a spinning rotor which is provided with a shaft for mounting and drive. The shafts of the spinning rotors extend into bearing housings, in which means are arranged for mounting the shafts and means are arranged for driving the shafts. To provide effective cooling of the high-speed means for mounting and/or driving, cooling air is provided to these means for mounting and/or driving directly by means of openings in the walls of the bearing housings with the shortest possible path.

23 Claims, 6 Drawing Figures

SPINNING UNIT OPERATING IN ACCORDANCE WITH THE OPEN-END METHOD

The present invention relates to a spinning unit operating in accordance with the open-end method and having a plurality of spinning points, each provided with a spinning rotor, rotating in rotor housings which preferably have an underpressure, with the rotor shafts extending through the rear walls of said rotor housings and into bearing housings which surround the bearing means and driving means of the spinning rotors.

This design of a spinning unit permits all highspeed members to be screened from the outside by means of the housing walls. In connection with the resulting relatively high speeds of rotation and speeds, the enclosed design causes the temperature to increase in the area of the bearing and driving means. The danger exists that the temperature exceeds the permissible amount, having an unfavorable effect on the service life of the bearing means.

It has already been proposed to pass a flow of air through common bearing housings for a plurality of spinning points extending longitudinally to the unit and forming an enclosed channel through the entire unit, in such a manner that said flow of air enters the channel at one end of the unit and egresses from the channel at the other end of the unit, with the air handling means being arranged at one end of the channel.

The object of the invention is to create a simple apparatus with favorable space requirements which effectively prevents an excessive increase in the temperature in the area of the bearing and driving means in the bearing housings and which has a reliable, uniform effect upon all bearing points.

According to the invention, air inlet openings are arranged in the walls of the bearing housings. These air inlet openings permit the introduction of individual flows of air, each of which is directed on the bearing points of one or only a few adjacent spinning points. This ensures that flows of air are available for the individual bearing points which can actually be termed flows of cooling air, as they are introduced from the outside, without being able to be heated up or loaded with impurities at other points in the spinning unit. It is practical for at least one inlet opening to be provided in the area of each spinning point. The air surrounding the unit can be sucked in directly through these openings. An especially advantageous air flow results if air chambers, which serve as the air supply channel, are interposed between the air inlet openings in the bearing housings. Additional advantages result if these air chambers are arranged between the rotor housings and the bearing housings and have at least one wall common therewith. This permits the rotor housing, which heats up relatively quickly, to be separated, in terms of heat, from the bearing housing, thereby providing a certain degree of additional cooling. It is especially practical for a plurality of spinning points to have a common air chamber and for a number of spinning points to have a known, common bearing housing. Air chambers of this type, in conjunction with common bearing housings for a plurality of spinning points, forming an enclosed channel extending longitudinally through the unit, can be fabricated especially economically and permit simple assembly. In order to be able to control the cooling effect precisely, a further development of the invention provides for advancing the cooling air to the air chambers through an air conditioning unit.

An effective embodiment of the invention which has a simple design provides at least a portion of the rotating members which drive the rotor with air handling means for the flows of cooling air. In this embodiment, each bearing point generally produces the necessary flow of cooling air itself. This provides the advantage that the flow of cooling air automatically increases as the speed of rotation increases. An especially advantageous development of this type results if the rotor shafts are mounted on pairs of supporting discs in a known manner and at least one of the supporting discs is provided with air handling means. It can also be practical to provide at least one supporting disc shaft with air handling means. The arrangement of air handling means directly on the shaft can also be practical with directly mounted rotor shafts. Depending on the embodiment of the rotor housing and bearing housing, it can be practical to arrange the air handling means for the cooling air flows in the air chambers or the walls thereof. Arrangements of this type can be especially compact.

The above discussed and other objects, features and advantages of the present invention will become more apparent from the following description thereof, when taken in connection with the accompanying drawings, in which FIG. 1 shows a vertical section through a spinning point designed in accordance with the invention having directly mounted rotor shaft and fan arranged thereon;

Figure 1:
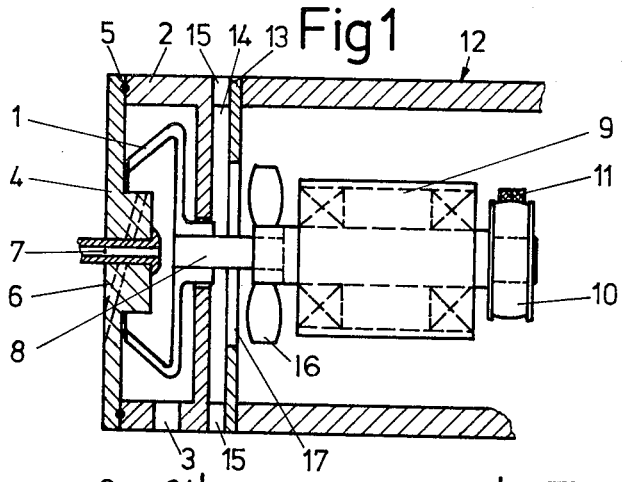

Referring now to the drawings, FIG. 1 shows a partial section of an individual spinning point in a spinning unit which has a plurality of similar spinning points arranged in a row one next to the other. Each spinning point has a spinning rotor 1 rotating in a housing 2 which has a certain underpressure. The bottom of rotor housing 2 has a connection 3 for appropriate vacuum piping means. The front side of rotor housing 2 is closed by a lid-type insert 4 with sealing means 5 provided therebetween. The insert has a fibre supply channel 6 arranged at an incline toward the interior and a fibre removal channel 7 extending axially to the spinning rotor.

The rotor shaft 8 of spinning rotor 1 extends through the rear wall of rotor housing 2 and is axially and radially mounted in a bearing 9. The end of rotor shaft 8 protruding beyond bearing 9 has a wharve 10 which is driven by a tangential belt 11. This tangential belt 11 drives all spinning rotors 1 located one next to the other on a side of the unit, for example.

Rotor shaft 8, bearing 9, wharve 10 and tangential belt 11 of all spinning points of the spinning unit are arranged in a channel 12, extending longitudinally to the spinning unit, of which the rear wall is not illustrated in the embodiment according to FIG. 1. The front wall 13 is formed by a screwed-on plate, arranged at a distance from the rear wall of rotor housing 2, which is also screwed on. This creates an additional channel 14 extending longitudinally to the spinning unit, which is employed as an air supply channel 14. Air supply channel 14 is in a connecting relationship with the ambient air by means of top and bottom openings 15, preferably arranged in the area of each spinning point.

In order to provide a flow of cooling air directed on bearing 9 in the area of each spinning point, a fan blade 16 is arranged in front of bearing 9 on rotor shaft 8, with an air inlet opening 17 in front wall 13 being associated thereto. Fan blade 16 sucks in outside air through this opening 17 and openings 15 and blows it onto bearing 9 as a flow of cooling air. Channel 12 has a plurality of unillustrated air outlet openings, arranged preferably in the area of its rear wall, through which the cooling air which is blown in can be evacuated again. Spinning rotor 1 is sealed in the rear wall of rotor housing 2 in such a manner that no infiltrated air can enter rotor housing 2 through the openings arranged there. To prevent the entrance of impurities, it is practical to arrange unillustrated air filters in the area of openings 15.

Figure 2:
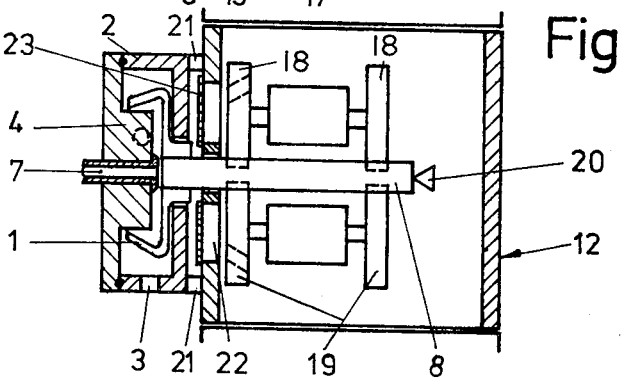
FIG. 2 shows a horizontal section through a further embodiment of the invention having the rotor shaft mounted on pairs of supporting discs.

The basic design of the embodiment shown in FIG. 2 corresponds to the embodiment according to FIG. 1, with rotor shaft 8 being mounted in a wedge-shaped gap formed by two pairs of supporting discs 18 and 19. Rotor shaft 8 is driven directly by means of an unillustrated tangential belt, with additional axial securing means 20, indicated only schematically, also being provided.

In a similar manner as in the embodiment according to FIG. 1, rotor housing 2 is attached to housing 12 in such a manner that its rear wall is arranged at a distance from the front wall of housing 12. The chamber created in this manner is in a connecting relationship with the outside air by means of openings 21. Arranged in the front wall of housing 12 are air inlet openings 22, which are associated to air handling means which direct a flow of cooling air on the bearings of pairs of supporting discs 18 and 19. In this embodiment, the air handling means are the two supporting discs facing the front wall of channel 12, which are designed as a sort of axial-flow fan. In this embodiment, air inlet openings 22 are covered with filters 23.

Figure 3:
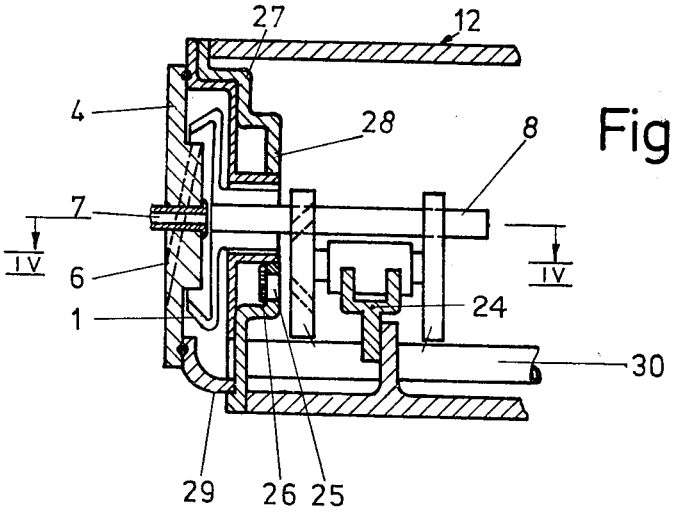
FIG. 3 shows a vertical section through an embodiment similar to that of FIG. 2, having a common bearing housing for a plurality of spinning points.

The embodiment shown in FIG. 3 shows a spinning point in which the rotor shaft 8 of a spinning rotor 1 is radially mounted in a wedge-shaped gap formed by two pairs of supporting discs 18 and 19 and having unillustrated, known axial securing means. Here, also, rotor shaft 8 is driven by means of an unillustrated tangential belt running directly on it, which drives all spinning rotors 1 on a side of the machine. Channel 12 is preferably formed by an extruded section, whose base has an upwardly protruding web, to which a rail section 24 is attached, said rail section mounting the pairs of supporting discs 18 and 19. In this embodiment also, the supporting discs facing the front wall of channel 12 are designed as air handling means, which suck in air through air inlet openings 25 and blow it onto the bearings as a flow of cooling air. Air inlet openings 25 are covered by filter elements 26.

In the embodiment shown in FIG. 3, the front wall of the channel is also formed of an extruded section 27, having in its center a U-shaped depression extending toward the interior of the channel and having air inlet openings 25. As can clearly be seen from FIG. 4 in particular, the front wall 27 has individual inserts 29 which serve as rotor housings. These inserts 29, which are preferably of plastic for example, are closed in a manner similar to the embodiments according to FIG. 1 or 2 by means of an insert 4 having a fibre supply channel 6 and a fibre removal channel 7. At the bottom, vacuum piping 30 is connected to insert 29 for providing the necessary underpressure in the rotor housing.

Inserts 29 are arranged at such a distance one from the other that a sufficient quantity of outside air can be introduced through the space between their rear wall and depression 28 in extruded section 27.

Figure 4:
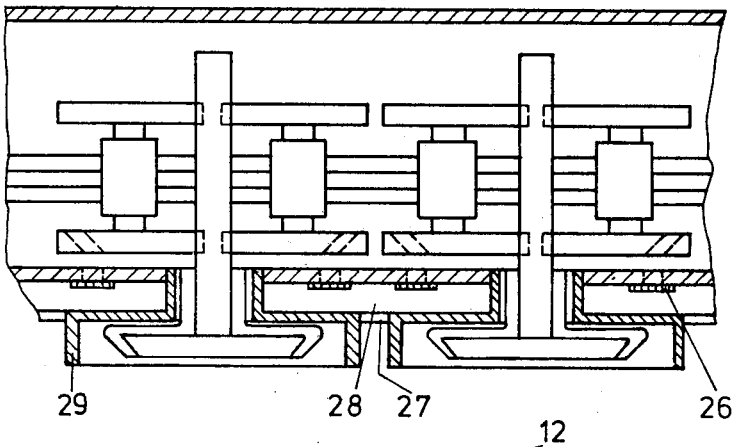
FIG. 4 shows a horizontal section through the embodiment according to FIG. 3 along line IV — IV in FIG. 3.
Figure 5:
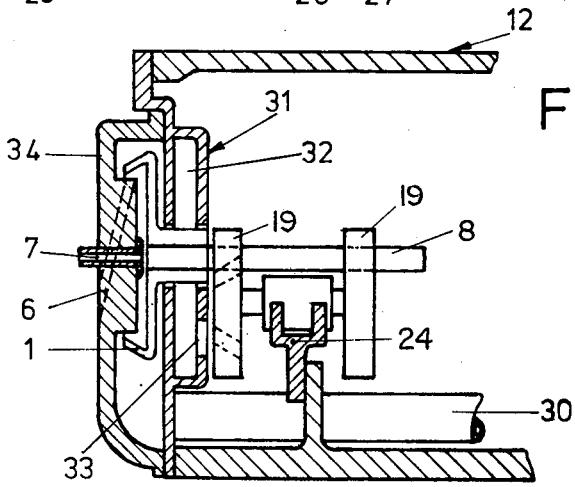
FIG. 5 shows a vertical section through a further embodiment having a common air chamber for a plurality of housings.

The basic principle of the embodiment shown in FIG. 5 corresponds to that of the embodiment according to FIGS. 3 and 4. Here, also, the front wall of channel 12 is an extruded section 31, which is designed as a hollow section and forms an air supply channel 32. Air inlet openings 33 are arranged in the wall of air supply channel 32 opposite the outer supporting discs. Here, also, the front supporting discs are designed as air handling means. In this embodiment, the rotor housing is formed by a lid 34 and section 31. In a similar manner to inserts 4 in the embodiment according to FIGS. 1 to 3, lid 34 has a fibre supply channel 6 and a fibre removal channel 7. The individual inserts 34 are dimensioned in such a manner that sufficient space remains therebetween for fresh air supply openings covered by filters.

In all illustrated embodiments, the air flow is produced by the rotating members, i.e., by the rotor shaft or a portion of the bearing means. This provides the advantage that the intensity of the air flow is a factor of the speed of rotation, which in turn directly influences the amount of heat. In addition, in all embodiments the cooling air intake is designed in such a manner that the cooling air flows around at least the rear of the rotor housing, providing a cooling effect here also.

Especially in the embodiments with a throughgoing air channel, e.g. the embodiment according to FIG. 1 or FIG. 5, it is possible to attach a compressed air source to this air channel, which then blows the cooling air into channel 12. Moreover, in many cases it will be logical to not only filter the incoming cooling air, but to air condition it by means of an air conditioning unit.

The additional cooling air flowing or blown into channel 12 can be evacuated at the end of the channel. In many cases, however, it will be practical to arrange air outlet openings at regular intervals along the channel, which can then be combined to form common piping means, in order to avoid an air backup or air distribution which is not uniform.

Figure 6:
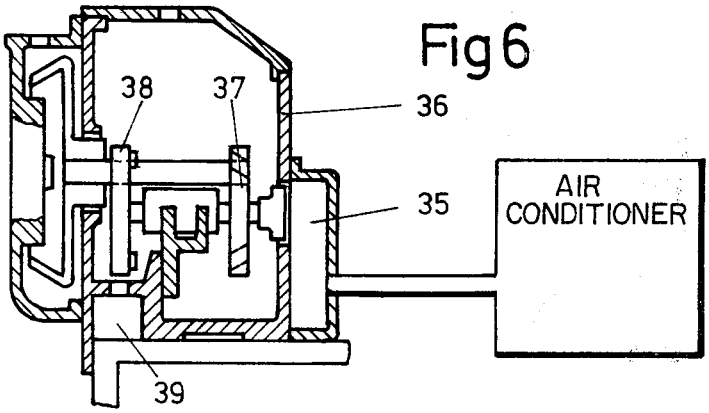
FIG. 6 shows a vertical section through an apparatus similar to that of FIG. 5, having an air chamber arranged behind the bearing housing.

FIG. 6 shows a further embodiment, in which the air supply channel 35 is provided at the rear side of the channel 36. In this embodiment, the rear supporting discs 37 serve as air handling means designed as a type of axial-flow fan. It is practical to connect one end of air supply channel 35 to an air conditioning unit. The top side of channel 36 has air outlet openings. The front supporting discs 38 are also designed as air handling means, which advance the cooling air to the bearings from a chamber 39. Chamber 39 is arranged in the bottom of channel 36, beneath supporting discs 38.

Obviously, many modifications and variations of the present invention are possible in the light of the above teachings. It should therefore be understood that within the scope of the appended claims, the invention may be practised otherwise than as specifically described.

Having thus fully disclosed our invention, what we claim is:

1. An open-end type spinning unit comprising:

a plurality of spinning stations which each have a spinning turbine disposed in turbine housing means, a turbine shaft attached to and rotatable with said spinning turbine and having a rear shaft portion extending through a rear wall of said turbine housing means, and a bearing assembly for rotatably supporting said shaft by way of engagement with said rear shaft portion, a common bearing housing arranged rearwardly of and adjacent to said turbine housing means for housing respective bearing assemblies and rear shaft portions for said plurality of spinning stations, common drive means disposed at least in part in said common bearing housing for rotatably driving the turbine shafts for said plurality of spinning stations, and at least one air inlet opening in said common bearing housing in the zone of each of the bearing assemblies contained therein for providing respective separate cooling air streams to each of said bearing assemblies, wherein air chambers are arranged in front of the air inlet openings leading into the common bearing housing.

2. The spinning unit according to claim 1, in which said air chambers serve as air supply channels.

3. The spinning unit according to claim 2, in which said air chambers are arranged between the turbine housing means and the common bearing housing and have at least one common wall with one of said turbine housing means and the common bearing housing.

4. The spinning unit according to claim 2, in which a plurality of spinning stations have a common air chamber.

5. The spinning unit according to claim 2, in which said air chambers are connected with an air conditioning unit.

6. The spinning unit according to claim 1, in which air handling means are arranged in the bearing housing.

7. The spinning unit according to claim 1, in which means for handling the cooling air are arranged in walls of the bearing housing.

8. An open-end type spinning unit comprising:

a plurality of spinning stations which each have a spinning turbine disposed in turbine housing means, a turbine shaft attached to and rotatable with said spinning turbine and having a rear shaft portion extending through a rear wall of said turbine housing means, and a bearing assembly for rotatably supporting said shaft by way of engagement with said rear shaft portion, a common bearing housing arranged rearwardly of and adjacent to said turbine housing means for housing respective bearing assemblies and rear shaft portions for said plurality of spinning stations, common drive means disposed at least in part in said common bearing housing for rotatably driving the turbine shafts for said plurality of spinning stations, at least one air inlet opening in said common bearing housing in the zone of each of the bearing assemblies contained therein for providing respective separate cooling air streams to each of said bearing assemblies, and air chambers arranged upstream of the respective air inlet openings leading into the common bearing housing.

9. The spinning unit according to claim 8, in which said bearing assemblies include air handling means for controlling the flow of cooling air from said air inlet opening.

10. The spinning unit according to claim 9, in which each of said shafts is mounted on pairs of supporting discs, of which at least one supporting disc is designed as said air handling means.

11. The spinning unit according to claim 8, wherein rotatable air handling means are provided in said common bearing housing for inducing and aiding flow of said cooling air from said air inlet openings to and over the respective bearing assemblies.

12. The spinning unit according to claim 11, wherein said rotatable air handling means include separate rotatable members for each bearing assembly which are driven by said common drive means whenever said turbine shafts are driven.

13. The spinning unit according to claim 8, wherein said at least one air inlet opening includes, for each bearing assembly, an inlet opening at the forward end of said common bearing box and an inlet opening at the rearward end of said common bearing box.

14. The spinning unit according to claim 8, wherein means are provided for maintaining a vacuum in each of said turbine housing means.

15. The spinning unit according to claim 8, wherein air flow handling means are provided for aiding the flow of cooling air into each of said at least one air inlet openings and around the respective bearing assemblies, wherein said bearing assemblies each include at least one pair of rotatable supporting discs engageable with respective ones of said rear shaft portions, and wherein said air flow handling means includes means rotatable with at least one of said discs.

16. The spinning unit according to claim 15, wherein said at least one of said discs is constructed as an axial flow fan.

17. The spinning unit according to claim 8, wherein means are provided to supply air from spaces outside of and separate from said turbine housing means to said air chambers.

18. An open-end spinning unit comprising:

a plurality of spinning stations which each have a spinning turbine disposed in turbine housing means, a turbine shaft attached to and rotatable with said spinning turbine and having a rear shaft portion extending through a rear wall of said turbine housing means, and a bearing assembly for rotatably supporting said shaft by way of engagement with said rear shaft portion, a common bearing housing arranged rearwardly of and adjacent to said turbine housing means for housing respective bearing assemblies and rear shaft portions for said plurality of spinning stations, common drive means disposed at least in part in said common bearing housing for rotatably driving the turbine shafts for said plurality of spinning stations, and at least one air inlet opening in said common bearing housing in the zone of each of the bearing assemblies contained therein for providing respective separate cooling air streams to each of said bearing assemblies, wherein, in the area of each of said at least one air inlet openings, an air chamber is provided which is bounded in the forward direction by said rear walls of the associated turbine housing means and in the rearward direction by a front wall provided on said common bearing housing, and wherein said at least one air inlet opening extends through said front wall of said common bearing housing.

19. An open-end spinning unit comprising:

a spinning station including a spinning turbine disposed in turbine housing means, a turbine shaft attached to and rotatable with said spinning turbine and having a rear shaft portion extending through a rear wall of said turbine housing means, and a bearing assembly for rotatably supporting said shaft by way of engagement with said rear shaft portion, a bearing housing arranged rearwardly of and adjacent to said turbine housing means for housing said rear shaft portion and said bearing assembly, drive means disposed at least in part in said bearing housing for rotatably driving the turbine shaft, at least one air inlet opening in said bearing housing in the zone of said bearing assembly for providing cooling air to said bearing assembly, an air chamber arranged upstream of the air inlet opening leading into the bearing housing, and air flow handling means for aiding the flow of cooling air into said at least one air inlet opening and around said bearing assembly, wherein said bearing assembly includes at least one pair of rotatable supporting discs engageable with said rear shaft portion, and wherein said air flow handling means includes means rotatable with at least one of said discs.

20. The spinning unit according to claim 19, wherein said at least one of said discs is constructed as an axial flow fan.

21. The spinning unit according to claim 19, wherein said bearing assembly includes two pairs of said discs spaced longitudinally from one another along the rear shaft portion, wherein one of the discs of the most forward pair is constructed as an axial flow fan which increases the air velocity therethrough in the rearward direction and wherein one of the discs of the most rearward pair is constructed as an axial flow fan which increases the air velocity therethrough in the forward direction.

22. The spinning unit according to claim 19, wherein means are provided for maintaining a vacuum in said turbine housing means.

23. The spinning unit according to claim 19, wherein means are provided to supply air from spaces outside of and separate from said turbine housing means to said air chambers.

* * * * *

UNITED STATES PATENT OFFICE
CERTIFICATE OF CORRECTION

Patent No. 3,934,396 Dated January 27, 1976

Inventor(s) Fritz STAHLECKER and Hans STAHLECKER

It is certified that error appears in the above-identified patent and that said Letters Patent are hereby corrected as shown below:

In item No. [76] the address of Fritz Stahlecker is changed to --D-7341 Bad Ueberkingen-- instead of "D-7341 Bad Veberkingen" as printed;

In item No. [56], references cited, the inventor's name in U. S. Patent No. 3,837,154 is changed to --Stahlecker-- instead of "Stablecker" as printed.

Signed and Sealed this
*fifteenth* Day of *June 1976*

[SEAL]

*Attest:*

RUTH C. MASON
*Attesting Officer*

C. MARSHALL DANN
*Commissioner of Patents and Trademarks*